US008863405B2

(12) United States Patent
Lee

(10) Patent No.: US 8,863,405 B2
(45) Date of Patent: Oct. 21, 2014

(54) CLOTHES DRYER

(75) Inventor: Junseok Lee, Changwon-Si (KR)

(73) Assignee: LG Electronics Inc., Seoul (KR)

( * ) Notice: Subject to any disclaimer, the term of this patent is extended or adjusted under 35 U.S.C. 154(b) by 53 days.

(21) Appl. No.: 13/432,299

(22) Filed: Mar. 28, 2012

(65) Prior Publication Data

US 2012/0246962 A1 Oct. 4, 2012

(30) Foreign Application Priority Data

Mar. 29, 2011 (KR) ..... 10-2011-0028393

(51) Int. Cl.
*D06F 58/10* (2006.01)
*D06F 58/20* (2006.01)

(52) U.S. Cl.
CPC ..... *D06F 58/20* (2013.01); *D06F 58/206* (2013.01)
USPC ..... 34/603; 34/134; 34/139

(58) Field of Classification Search
CPC ..... D06F 58/24; D06F 58/10
USPC ..... 34/72–75, 77, 79, 86, 124–125, 130, 34/132, 134, 138–139, 235, 443, 467–468, 34/470, 477, 513–515, 583, 595, 601, 603, 34/604, 607; 62/324.1
See application file for complete search history.

(56) References Cited

U.S. PATENT DOCUMENTS

| | | | | | |
|---|---|---|---|---|---|
| 5,152,077 | A * | 10/1992 | Liang | ..... | 34/77 |
| 5,852,881 | A * | 12/1998 | Kuroda et al. | ..... | 34/527 |
| 7,552,545 | B2 * | 6/2009 | Crawford et al. | ..... | 34/600 |
| 2008/0034607 | A1 * | 2/2008 | Ahn et al. | ..... | 34/130 |
| 2010/0011608 | A1 * | 1/2010 | Grunert et al. | ..... | 34/85 |
| 2010/0199512 | A1 * | 8/2010 | Tomochika et al. | ..... | 34/73 |

FOREIGN PATENT DOCUMENTS

| | | | | |
|---|---|---|---|---|
| IT | EP1209277 | * | 9/2001 | ..... D06F 58/24 |
| JP | 07178289 | * | 7/1995 | ..... D06F 58/02 |
| JP | 2009291226 A | * | 12/2009 | |
| KR | 2006018731 A | * | 3/2006 | |

* cited by examiner

*Primary Examiner* — Jiping Lu
(74) *Attorney, Agent, or Firm* — Ked & Associates, LLP

(57) ABSTRACT

Disclosed is a clothes dryer, which includes: a main body in which a drum is rotatably installed; a circulation passage which becomes a path of the air passing through the drum in the main body to dry the clothes; a heat exchanger composed of an evaporator, a compressor, an expansion valve and a condenser to cool and heat the air on the circulation passage; an inlet port provided on one lateral surface of the main body to inhale the outdoor air; and an outlet port provided on the bottom surface of the main body to discharge the outdoor air.

16 Claims, 6 Drawing Sheets

CLOTHES DRYER

CROSS-REFERENCE TO RELATED APPLICATION

Pursuant to 35 U.S.C. §119(a), this application claims the benefit of earlier filing date and right of priority to Korean Application No. 10-2011-0028393, filed on Mar. 29, 2011, the contents of which are incorporated by reference herein in its entirety.

BACKGROUND OF THE INVENTION

1. Field of the Invention

The present disclosure relates to a clothes dryer having an outdoor air inlet port, and particularly, to a clothes dryer which can efficiently externally discharge heat generated in a heat exchanger, which serves to cool the hot air supplied into a drum and heat the air, and heat generated in inner devices of the clothes dryer, thus preventing damages to the inner devices of the clothes dryer.

2. Background of the Invention

In general, a clothes dryer is an apparatus for drying the clothes. In detail, when the clothes, which are subject to washing and dehydration, are put into a drum (or tub) of the clothes dryer, the hot air is supplied into the drum to evaporate moisture of the clothes.

The air, which evaporates moisture of the clothes in the drum of the clothes dryer, contains moisture of the clothes in the drum, and thus becomes hot and humid. Here, the clothes dryers can be classified according to methods of treating the hot and humid air. More specifically, the clothes dryers can be divided into a condensing type clothes dryer, which condenses moisture contained in the hot and humid air by circulating the hot and humid air to exchange heat in a heat exchanger, instead of discharging the air to the outside, and a discharge type clothes dryer, which directly externally discharges the hot and humid air passing through a drum.

In the condensing type clothes dryer, the hot and humid air can be cooled and heated by the heat exchanger and can be further heated by a separate heater. This clothes dryer includes various devices, such as a compressor for actuating the heat exchanger, etc.

The aforementioned devices are mounted in the clothes dryer and emit heat in use. In order to ensure stability of the inner devices in use, the heat must be discharged from the inside to the outside of the clothes dryer.

A method of inhaling the outdoor air, making the air absorb heat, and discharging the air has been suggested to externally discharge the heat generated in the inner devices of the clothes dryer.

However, the clothes dryer has a following problem in that, since it accommodates various devices, if an air passage is not efficiently established, the heat generated is not discharged to the outside but accumulated on the inside, thus having a detrimental effect on the operation of the inner devices.

Meanwhile, the position of an outlet port for discharging the air from the inside to the outside, should also be significantly considered in the clothes dryer. That is, when the air is discharged through the front surface or the lateral surface, it degrades the external appearance of the clothes dryer and makes the user unpleasant in use. In addition, there is a risk of inefficiently discharging the air.

SUMMARY OF THE INVENTION

Therefore, an aspect of the detailed description is to provide a clothes dryer having an efficient air passage, through which heat generated in inner devices of the clothes dryer can be discharged to the outside by the outdoor air.

Another aspect of the detailed description is to provide a clothes dryer which can efficiently discharge the indoor air to the outside.

A further aspect of the detailed description is to provide a clothes dryer which has a better external appearance and makes the user pleasant in use.

To achieve these and other advantages and in accordance with the purpose of this specification, as embodied and broadly described herein, a clothes dryer includes: a main body in which a drum is rotatably installed; a circulation passage which becomes a path of the air passing through the drum in the main body to dry the clothes; a heat exchanger composed of an evaporator, a compressor, an expansion valve and a condenser to cool and heat the air on the circulation passage; an inlet port provided on one lateral surface of the main body to inhale the outdoor air; and an outlet port provided on the bottom surface of the main body to discharge the outdoor air, wherein the outdoor air inhaled into the main body through the inlet port is discharged to the bottom surface of the main body through the outlet port, thus forming an outdoor air passage, the bottom surface of the main body is divided into a first surface, on which the circulation passage is formed and the evaporator and the condenser are mounted, and a second surface, on which the outdoor air passage is formed and the compressor is mounted, and the compressor is provided on the outdoor air passage to be able to exchange heat with the outdoor air.

The evaporator and the condenser are sequentially provided on the circulation passage, while the compressor is provided on the lateral side of the evaporator and the condenser.

The inlet port and the outlet port are provided on the second surface. Here, the inlet port is formed on the rear surface of the main body so that the outdoor air can be introduced through the rear surface of the main body. In addition, a suction fan for guiding the outdoor air passage may be provided on the inlet port.

Here, the outlet port may be disposed adjacent to the evaporator or the condenser.

Alternatively, the outlet port may be disposed adjacent to the front surface of the main body. In this case, the outlet port is disposed between the compressor and the front surface of the main body.

Here, the inlet port and the outlet port may be formed on the same level.

Meanwhile, the clothes dryer may further include a discharge wall upwardly projecting from the bottom surface of the main body, being hollow, and having an open bottom, wherein the outlet port is formed on one surface of the discharge wall.

The discharge wall includes a first wall surface having the outlet port and a second wall surface opposing the first wall surface, wherein the outdoor air inhaled into the main body through the inlet port passes through the outlet port, and then is discharged to the open bottom through the space between the first wall surface and the second wall surface.

The second wall surface is inclined to the first wall surface.

Here, the discharge wall may be disposed adjacent to the evaporator or the condenser. In this case, the discharge wall is provided on the bottom surface of the main body to be orthogonal to the inlet port, such that the outdoor air passage direction in the inlet port is orthogonal to the outdoor air passage direction to the outlet port.

In the meantime, the discharge wall may be provided on the bottom surface of the main body to oppose the inlet port. In this case, the outlet port is opposite to the inlet port.

The clothes dryer according to the present invention has an efficient air passage for smoothly discharging the air, by forming the discharge wall on the same level as the inlet port so that the air can be discharged through the discharge wall.

In addition, the clothes dryer according to the present invention has high cooling efficiency by forming the inclined surface on the discharge wall so that the air can be efficiently transferred to the outside.

Moreover, the clothes dryer according to the present invention has a better external appearance and makes the user pleasant in use by discharging the air through the bottom surface of the clothes dryer.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from the detailed description.

BRIEF DESCRIPTION OF THE DRAWINGS

The accompanying drawings, which are included to provide a further understanding of the invention and are incorporated in and constitute a part of this specification, illustrate exemplary embodiments and together with the description serve to explain the principles of the invention.

In the drawings.

DETAILED DESCRIPTION OF THE INVENTION

Description will now be given in detail of the exemplary embodiments, with reference to the accompanying drawings. For the sake of brief description with reference to the drawings, the same or equivalent components will be provided with the same reference numbers, and description thereof will not be repeated.

Figure 1:
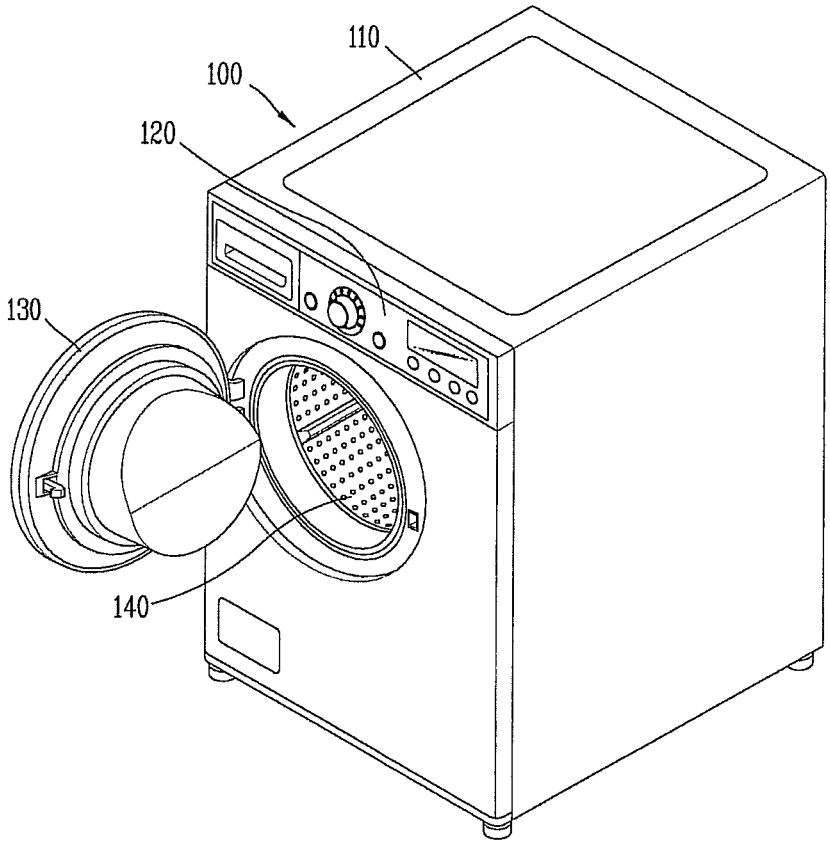
FIG. 1 is a perspective view showing the external appearance of an embodiment of a clothes dryer of the present invention.

FIG. 1 is a schematic view showing the external appearance of an embodiment of a clothes dryer of the present invention. Referring to FIG. 1, a clothes dryer 100 includes a cabinet 110, which is a main body with a door 130 on its front surface, and a drum 140, which is rotatably installed in the main body 110 and has a plurality of lifters projecting from its inner circumference. In addition, a control panel 120 having a display window and operation buttons is provided on the front surface of the main body.

Figure 2:
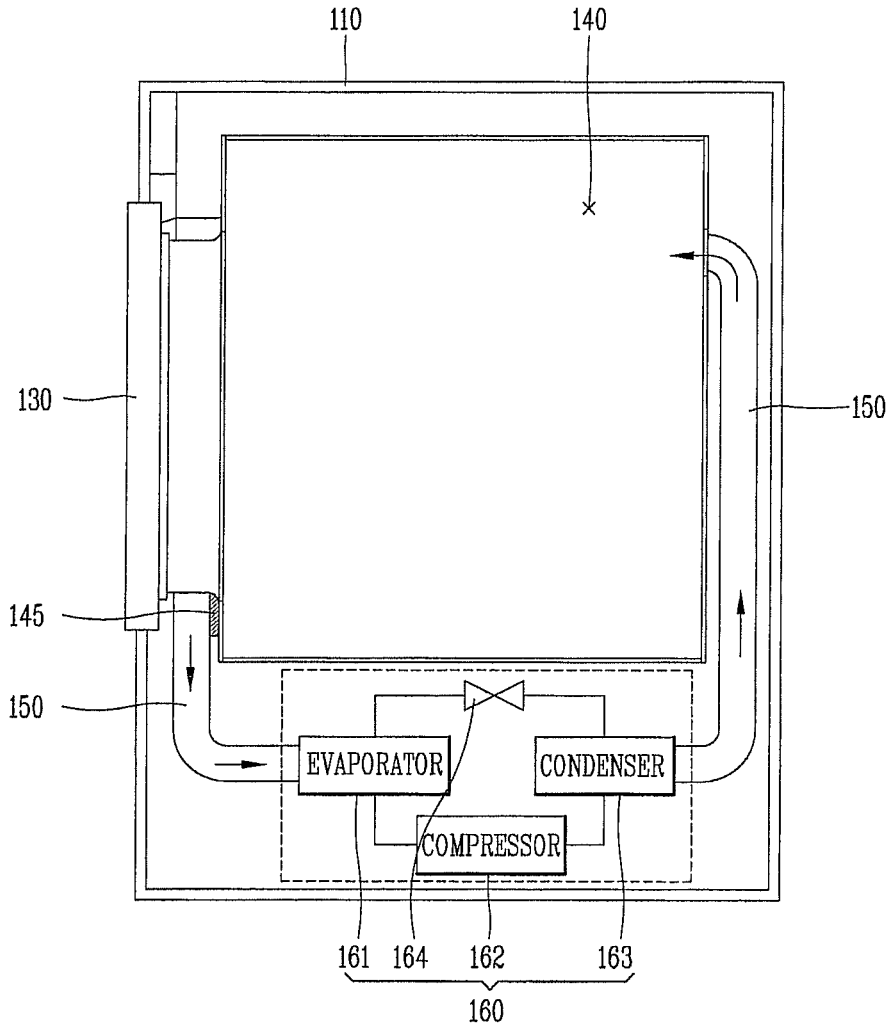
FIG. 2 is a schematic view showing the inner configuration of the clothes dryer of FIG. 1.

FIG. 2 is a side-sectional view showing the clothes dryer. Referring to FIG. 2, a circulation duct 150 communicates with the drum 140 rotated in the main body 110 by a driving motor. The hot air is discharged from the circulation duct 150, which communicates with the rear portion of the drum 140, to the drum to dry the clothes in the drum.

The air, which is used to dry the clothes, becomes humid due to moisture evaporated from the clothes, and then is discharged to the circulation duct 150, which communicates with the front portion of the drum adjacent to the door. Here, alien substances which may be contained in the humid air can be filtered off by a lint filter 145 disposed between the front portion of the drum and the circulation duct. This air flow is more efficiently created by a blower fan (not shown) provided on the circulation duct.

Meanwhile, a heat exchanger 160 is provided in the main body to exchange heat with the air circulated in the circulation duct. The heat exchanger is preferably a heat pump. The heat exchanger provided as the heat pump is configured by sequentially connecting an evaporator 161, a compressor 162, a condenser 163 and an expansion valve 164 via wires.

The devices of the heat pump, which directly exchange heat with the circulated air, are the evaporator 161 and the condenser 163. Refrigerant, which is circulated in the heat pump, is evaporated in the evaporator by absorbing heat from the hot and humid air discharged from the drum. Thus, the circulated air is cooled, and moisture contained in the air is condensed and dropped to the bottom surface of the main body because of gravity.

In the meantime, refrigerant, which is circulated in the heat pump, is evaporated in the evaporator, compressed in the compressor at a high temperature and high pressure, and then condensed in the condenser by transferring heat to the cooled air. As a result, the circulated air is heated to be hot and dry, and then discharged again to the drum 140 by the circulation duct. In addition, the cooled refrigerant is insulation-expanded through the expansion valve, so that it can absorb heat in the evaporator again.

Figure 3:
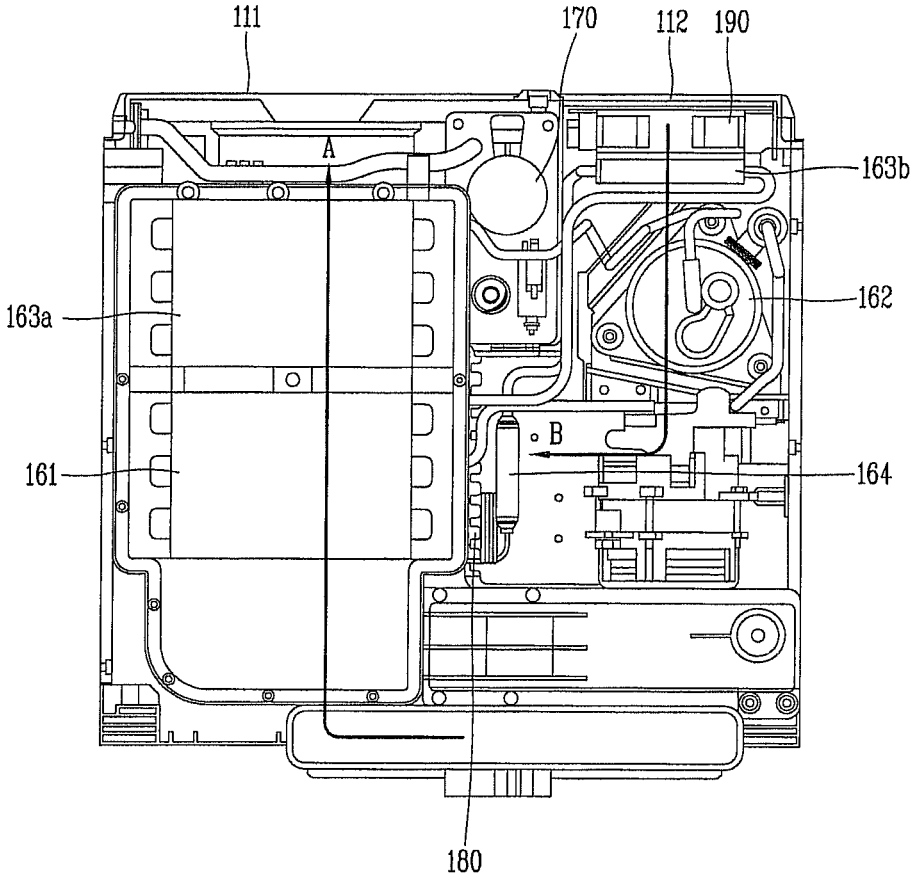
FIG. 3 is a schematic view showing the arrangement of inner devices on the bottom surface of the clothes dryer of FIG. 1.

FIG. 3 shows the heat exchanger 160 mounted on the bottom surface of the main body. Referring to FIG. 3, arrow A indicates the circulation passage, which is a path of the air circulated in the circulation duct. The evaporator 161 and the first condenser 163*a*, which directly exchange heat with the circulated air, are disposed on the circulation passage (arrow A), respectively.

The air circulated in the circulation passage passes through the drum in the main body to dry the clothes. Therefore, the heat exchanger cools and heats the air on the circulation passage.

In FIG. 3, the condenser 163 is composed of a first condenser 163*a* and a second condenser 163*b*. In order to improve efficiency, the condenser is divided into the first condenser and the second condenser, wherein the first condenser serves to exchange heat with the circulated air, and the second condenser serves to exchange heat with the outdoor air. Additionally, still referring to FIG. 3, the compressor 163 and the expansion valve 164 are disposed on the right side of the first compressor and the evaporator, respectively, and the aforementioned devices are connected through wires.

Meanwhile, in FIG. 3, arrow B indicates the outdoor air passage. The outdoor air is introduced through an inlet port 112 provided on the rear surface of the main body, and then discharged through a discharge wall 180 having an outlet port, which will be discussed later. The outdoor air inhaled into the main body through the inlet port is discharged to the bottom surface of the main body through the outlet port, thus forming the outdoor air passage. Therefore, the outdoor air is introduced into the main body through the rear surface of the main body, and the outdoor air passage is indicated by arrow B. A suction fan 190, which serves to increase the inhalation of the air and guide the outdoor air passage, may be further provided on the inlet port 112.

Here, the bottom surface of the main body may be divided into a first surface, on which the circulation passage is formed and the evaporator and the condenser are mounted, and a second surface, on which the outdoor air passage is formed and the compressor is mounted. In other words, referring to FIG. 3, the left side of the bottom surface of the clothes dryer, on which the evaporator and the condenser are sequentially mounted and the circulation passage is formed, corresponds to the first surface. Additionally, the left side of the bottom surface of the clothes dryer, on which the compressor is mounted and the outdoor air passage is formed, corresponds to the second surface. As described above, the compressor is provided on the lateral side of the evaporator and the condenser.

In the aspects of the above configuration, since the compressor is provided on the outdoor air passage of the second surface, it can exchange heat with the outdoor air, which prevents overheating in the main body of the clothes dryer.

The inlet port and the outlet port for forming the outdoor air passage are provided on the second surface-side. In other words, the inlet port and the outlet port are formed on the second surface-side without crossing the circulation passage, such that the outdoor air passage can be guided to the second surface.

Figure 4:
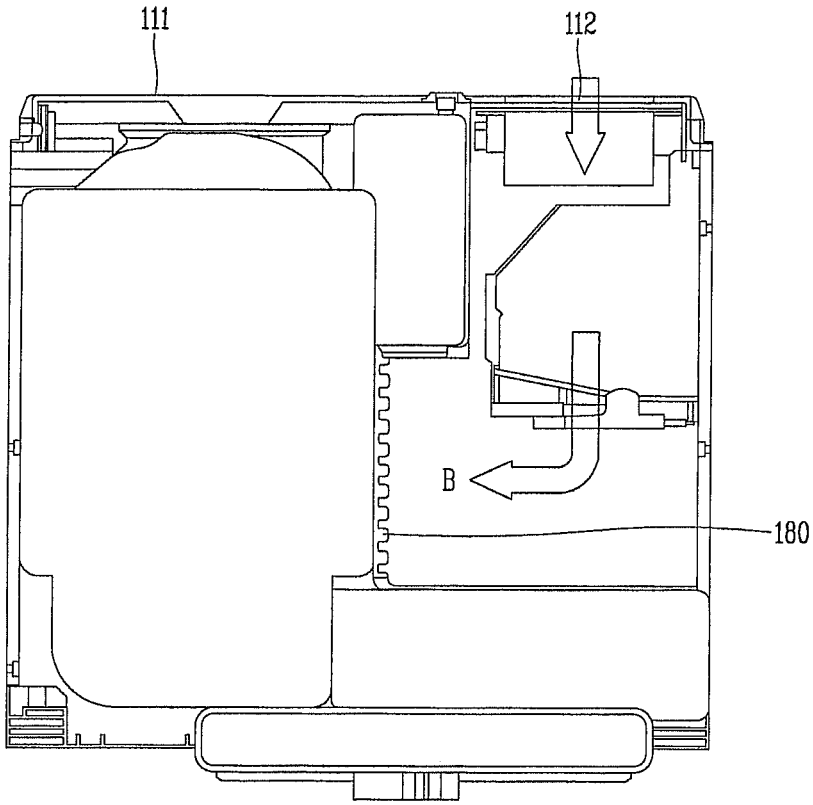
FIG. 4 is a schematic view showing an outdoor air passage in an embodiment of the present invention.

Here, the outlet port may be disposed adjacent to the evaporator or the condenser, an example of which is shown in FIG. 4. That is, the outlet port is formed on the interface with the first surface.

Figure 5:
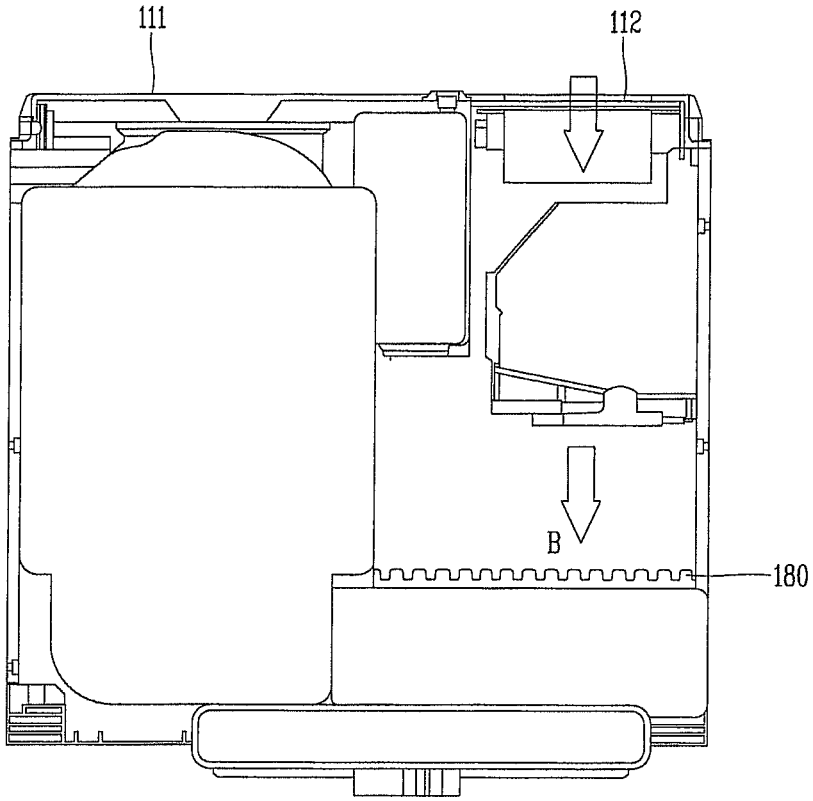
FIG. 5 is a schematic view showing an outdoor air passage in another embodiment of the present invention.

In addition, the outlet port may be disposed adjacent to the front surface of the main body, an example of which is shown in FIG. 5. That is, the outlet port is disposed between the compressor and the front surface of the main body.

Figure 6:
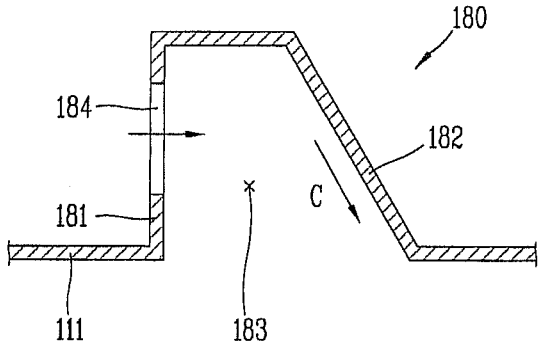
FIG. 6 is a schematic side-sectional view showing a discharge wall in the embodiments of the present invention.

Meanwhile, the outlet port may be formed on the discharge wall. The discharge wall 180 becomes a path, through which the inhaled air absorbing heat is discharged to the outside again. As concretely shown in FIG. 6, the discharge wall upwardly projects from the bottom surface 111 of the main body, is hollow, and has an open bottom. Referring to FIG. 6, the discharge wall 180 includes a first wall surface 181 and a second wall surface 182 opposing the first wall surface.

A space 183, which temporarily collects and discharges the air to the bottom, is defined between the first wall surface and the second wall surface. Thus, the lower portion of the space is open to the outside.

Figure 7:
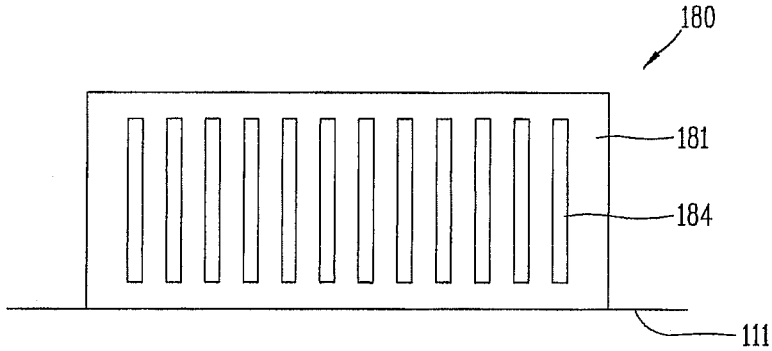
FIG. 7 is a schematic view showing an example of an outlet port of the present invention.
Figure 8:
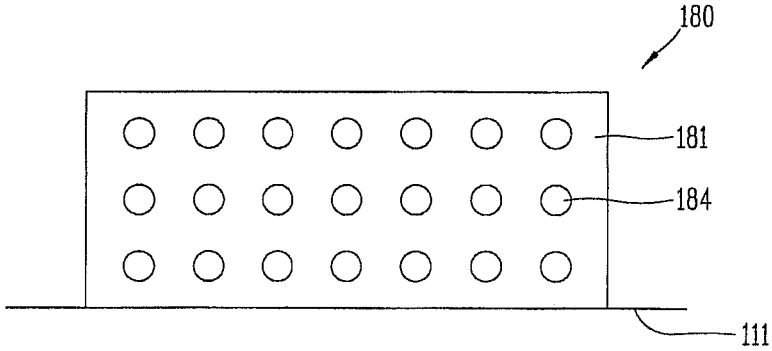
FIG. 8 is a schematic view showing another example of an outlet port of the present invention.

Additionally, an outlet port 184, through which the air can pass, is formed on the first wall surface, an example of which is shown in FIG. 7. Referring to FIG. 7, the outlet port 184 may be provided as a plurality of slits arranged at regular intervals. Another example of the outlet port is shown in FIG. 8. Referring to FIG. 8, the outlet port may be provided as a plurality of circles arranged at regular intervals in the width and length directions. Any shape of outlet port can be used, as far as it allows the air to smoothly pass through the first wall surface.

Here, the second wall surface 182 is inclined to the first wall surface. Referring back to FIG. 6, the inclined surface of the second wall surface is downwardly inclined away from the first wall surface. This configuration of the present invention allows the air to enter the outlet port of the first wall surface and flow along the inclined surface, so that the air is not stagnant in the space between the first wall surface and the second wall surface but keeps flowing smoothly.

The outdoor air inhaled into the main body through the inlet port 112 is discharged to the open bottom through the space between the first wall surface and the second wall surface. Here, the inlet port 112 and the output port 184 are formed on the same level.

While the air does not have a certain shape, it forms a certain flow. Thus, it is efficient to transfer the air flow on the same level. In the embodiments of the present invention, the outlet port 184 is formed on the same or similar level as the inlet port 112. Accordingly, the inhaled air can be transferred to the outlet port 184 without having a level change on the air passage, which makes it possible to form an efficient air passage.

In one embodiment of the present invention, the discharge wall 180 may be provided as a partition for separating the condenser from the compressor of the heat exchanger. In other words, as shown in FIG. 4, the discharge wall 180 can be used as the partition for separating the first surface (left side), on which the condenser is mounted, from the second surface (right side), on which the compressor is mounted. Therefore, the inhaled air can be transferred to the outlet port 184 without having a level change on the air passage (arrow B) of FIG. 4, which makes it possible to form an efficient air passage.

Alternatively, in another embodiment of the present invention, as shown in FIG. 5, the discharge wall 180 may be provided on the bottom surface of the main body, opposing the inlet port 112. Here, the first wall surface 181 is opposite to the inlet port. That is, the outlet port 184 of the discharge wall and the inlet port 112 are opposite to each other on the same level. As such, the inhaled air can be transferred to the outlet port 184 without having a level or direction change on the air passage (arrow B) of FIG. 5, which makes it possible to form an efficient air passage.

The outdoor air inhaled into the main body through the inlet port exchanges heat with the compressor of the heat exchanger, and then is discharged to the open bottom of the discharge wall through the outlet port. In addition to the compressor, the second condenser of the heat exchanger can exchange heat with the outdoor air. As described above, the heat exchanger 160, which constitutes the heat pump, includes the first condenser 163*a* provided on the circulation passage A and the second condenser 163*b* provided on the inlet port-side. The outdoor air inhaled into the main body through the inlet port exchanges heat with the second condenser 163*b* and the compressor 162, and then is discharged to the open bottom of the discharge wall 180 through the outlet port 184. It can be easily understood through the passage indicated by arrow B in FIG. 3.

In the aspects of the above configuration of the present invention, since the outlet port is formed on the same level as the inlet port, the air can be easily discharged through the discharge wall. Accordingly, it is possible to efficiently form the air passage in the clothes dryer so that it can smoothly discharge the air. In addition, it is possible to improve cooling efficiency of the clothes dryer by forming the inclined surface on the discharge wall so that the air can be efficiently transferred to the outside. Moreover, it is possible to improve the external appearance of the clothes dryer and make the user pleasant in use by discharging the air through the bottom surface of the clothes dryer.

The foregoing embodiments and advantages are merely exemplary and are not to be construed as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A clothes dryer, comprising:

a cabinet in which a drum is rotatably installed;

a circulation passage which becomes a path of the air passing through the drum in the cabinet to dry the clothes;

a heat exchanger comprising an evaporator, a compressor, an expansion valve and a condenser to cool and heat the air in the circulation passage;

an inlet port provided on a surface of the cabinet through which the outdoor air flows;

a discharge wall upwardly projecting from a bottom surface of the cabinet and being configured to discharge the outdoor air therethrough toward beneath the bottom of the cabinet, the discharge wall having a first wall surface; and an outlet port provided on the first wall surface to discharge outdoor air, wherein the outdoor air flowing into the cabinet through the inlet port is discharged through the outlet port, thus forming an outdoor air passage, the outdoor air passage is independent from the circulation passage, the first wall surface is configured such that the outlet port opens toward a downstream of the outdoor air passage and the compressor is provided in the outdoor air passage to exchange heat with the outdoor air.

2. The clothes dryer as claimed in claim 1, wherein the evaporator and the condenser are sequentially provided in the circulation passage, while the compressor is provided on the lateral side of the evaporator and the condenser.

3. The clothes dryer as claimed in claim 1, wherein the bottom surface of the cabinet is divided into a first surface, on which the circulation passage is formed and the evaporator and the condenser are mounted, and a second surface, on which the outdoor air passage is formed and the compressor is mounted, and wherein the inlet port and the outlet port are provided on the second surface.

4. The clothes dryer as claimed in claim 1, wherein the inlet port is formed on the rear surface of the cabinet so that the outdoor air can be introduced through the rear surface of the cabinet.

5. The clothes dryer as claimed in claim 1, further comprising a suction fan provided on the inlet port to guide the outdoor air passage.

6. The clothes dryer as claimed in claim 1, wherein the outlet port is disposed adjacent to the evaporator or the condenser.

7. The clothes dryer as claimed in claim 1, wherein the outlet port is disposed adjacent to the front surface of the cabinet.

8. The clothes dryer as claimed in claim 1, wherein the outlet port is disposed between the compressor and the front surface of the cabinet.

9. The clothes dryer as claimed in claim 1, wherein the inlet port and the outlet port are formed on a same level.

10. The clothes dryer as claimed in claim 9, wherein the first wall surface is provided as a partition to separate the condenser from the compressor.

11. The clothes dryer as claimed in claim 1, wherein the discharge wall being hollow and having an open bottom.

12. The clothes dryer as claimed in claim 11, wherein the discharge wall further comprises a second wall surface opposing the first wall surface, wherein the outdoor air flows into the cabinet through the inlet port passes through the outlet port, and then is discharged to the open bottom through a space between the first wall surface and the second wall surface.

13. The clothes dryer as claimed in claim 12, wherein the second wall surface is inclined to the first wall surface.

14. The clothes dryer as claimed in claim 11, wherein the discharge wall is disposed adjacent to the evaporator or the condenser.

15. The clothes dryer as claimed in claim 1, wherein the first wall surface is approximately perpendicularly extending from the bottom surface of the cabinet.

16. The clothes dryer as claimed in claim 1, wherein the first wall surface is opposite to the inlet port.

* * * * *